US005691029A

United States Patent [19]

Lucas

[11] Patent Number: 5,691,029

[45] Date of Patent: Nov. 25, 1997

[54] FILAMENT-REINFORCED NONWOVEN-FABRIC SHEETING

[75] Inventor: Leonardus Johannes Lucas, Duiven, Netherlands

[73] Assignee: AKzo Nobel NV, Arnhem, Netherlands

[21] Appl. No.: 470,611

[22] Filed: Jun. 6, 1995

[30] Foreign Application Priority Data

Jun. 16, 1994 [DE] Germany ..... 44 20 811.1

[51] Int. Cl.[6] ..... B32B 5/12

[52] U.S. Cl. ..... 428/107; 428/105; 428/114; 442/364; 442/366

[58] Field of Search ..... 428/113, 287, 428/294, 296, 298, 302, 373, 105, 114, 107; 442/364, 366

[56] References Cited

U.S. PATENT DOCUMENTS

| | | | |
|---|---|---|---|
| 4,722,857 | 2/1988 | Tomioka et al. | 428/113 |
| 5,118,550 | 6/1992 | Baravian et al. | 428/90 |
| 5,178,924 | 1/1993 | Johnson et al. | 428/40 |
| 5,200,246 | 4/1993 | Sabee | 428/109 |
| 5,431,991 | 7/1995 | Quantrille et al. | 428/109 |

FOREIGN PATENT DOCUMENTS

| | | | |
|---|---|---|---|
| 0 506 051 | 3/1992 | European Pat. Off. . | |
| 506501 | 9/1992 | European Pat. Off. | D04H 5/06 |

*Primary Examiner*—James J. Bell
*Attorney, Agent, or Firm*—Joseph M. Noto; Louis A. Morris

[57] ABSTRACT

Filament-reinforced nonwoven-fabric sheeting reinforced by sheets of parallel reinforcement yarns integrated into the nonwoven-fabric sheeting, whereby a binder is used to bind the filaments A forming the nonwoven fabric to filaments B of the reinforcement yarns at the crossing points of filaments A and B, and to bind filaments B to each other at least at some points, wherein the filaments A of the nonwoven fabric are also bound to each other at their crossing points by the same binder is disclosed.

25 Claims, No Drawings

FILAMENT-REINFORCED NONWOVEN-FABRIC SHEETING

CROSS REFERENCE TO RELATED APPLICATIONS

This application claims the benefit of the filing date of prior German Patent Application Number P 44 20 811.1, filed Jun. 16, 1994, which is incorporated herein by reference in its entirety.

BACKGROUND OF THE INVENTION

1. Field of the Invention

The present invention relates to filament-reinforced nonwoven-fabric sheeting that is reinforced by sheets of parallel reinforcement yarns integrated into the nonwoven-fabric sheeting.

2. Description of the Related Art

Nonwoven-fabric sheeting is described in EP-A-0 506 051, as being employed as an interlining for bituminous sheeting and also as sheeting for roofing underlayers. Binders in solution or dispersion form, as well as fusible binders, are used to bond the nonwoven fabric and to bind the nonwoven fabric to the reinforcement yarns. In the case of a fusible binder, the fusible binder is incorporated in the nonwoven fabric in the form of separate binder filaments, or at least a portion of the filaments of the reinforcement yarns are bicomponent filaments in which one of the components serves as a fusible binder. With the nonwoven-fabric sheeting in the art, it has been noted either that the delamination properties are not entirely satisfactory in all locations or that the breaking strength is not as high as should be expected considering the quantity of reinforcement yarns used.

SUMMARY OF THE INVENTION

In accordance with one aspect of the present invention, there is provided a nonwoven-fabric sheeting in which practically no delamination is observable, even in small areas, and which has an exceptionally high stability at a low weight per unit area.

In accordance with another aspect of the present invention, there is provided filament-reinforced nonwoven-fabric sheeting reinforced by sheets of parallel reinforcement yarns integrated into the nonwoven-fabric sheeting, whereby a binder binds (i) filaments A forming the nonwoven fabric to filaments B of the reinforcement yarns at the crossing points of filaments A and B, (ii) filaments B to each other at least at some points, and (iii) filaments A of the non-woven fabric to each other at their crossing points.

These and other aspects of the present invention will become apparent upon a review of the following detailed description and the claims appended thereto.

DETAILED DESCRIPTION OF PREFERRED EMBODIMENTS

The present invention relates to filament-reinforced nonwoven-fabric sheeting that is reinforced by sheets of parallel reinforcement yarns integrated into the nonwoven-fabric sheeting, whereby a binder is used to bind the filaments A forming the nonwoven fabric to filaments B of the reinforcement yarns at the crossing points of filaments A and B, and to bind filaments B to each other at least at some points, the nonwoven-fabric sheeting being distinguished by the fact that filaments A of the nonwoven fabric are also bound to each other at their crossing points by the same binder.

The reinforcement yarns are preferably oriented at least substantially in the longitudinal direction of the nonwoven-fabric sheeting.

Multiple sheets of parallel reinforcement yarns can be present, however, in which case it is advantageous for at least two sheets of the reinforcement yarns integrated into the nonwoven-fabric sheeting to cross each other. It has proven especially satisfactory in this case for one sheet to be oriented at least substantially in the longitudinal direction and another sheet at least substantially in the transverse direction. The crossing arrangement of reinforcement yarns leads to particularly good shape stability in the nonwoven-fabric sheeting of the invention. It also exhibits practically no ripple. Through suitable selection of the crossing angles of the reinforcement yarns, the tensile strength and modulus of the invention-related nonwoven-fabric sheeting can be influenced in specific directions. If the reinforcement yarns are oriented longitudinally and transversely, for example, the strength and modulus in the longitudinal and transverse directions can, by varying the number of reinforcement yarns per unit length, be adjusted to be either different or of equal magnitude. Crossing reinforcement yarns can also improve the tear propagation resistance of the nonwoven-fabric sheeting.

It is advantageous for the nonwoven-fabric sheeting of the present invention to have a nonwoven-layer weight between 50 and 300 g/m$^2$.

Nonwoven-fabric sheeting in which the binder serves to bind the filaments of the nonwoven fabric to each other, the filaments of the nonwoven fabric to the filaments of the reinforcement yarns, and the filaments of the reinforcement yarns to each other, is not described by EP-A-0 506 051. It is also surprising that this process results in practically no observable delamination, even in small areas, and at the same time increases stability.

The nonwoven-fabric sheeting of the present invention is distinguished in particular by the fact that the binder is a fusible binder with a melting point lower than that of filaments A and B of the nonwoven-fabric sheeting.

With the nonwoven-fabric sheeting of the present invention, it is especially advantageous for filaments A of the nonwoven fabric and filaments B of the reinforcement yarns to be made of similar polymers, in particular the same polymer. It is of advantage to employ bicomponent filaments for filaments A of the nonwoven fabric and/or filaments B of the reinforcement yarns.

An objective of the present invention is achieved especially well in the nonwoven-fabric sheeting of the invention when filaments A of the nonwoven fabric and filaments B of the reinforcement yarns consist of bicomponent filaments in which one of the filament bicomponents is the fusible binder. It is particularly beneficial for the bicomponent filaments to be sheath/core filaments, where the sheath is the fusible binder.

Practically all fusible polymers are suitable as the components of the sheath/core filaments, for example polyethylene terephthalate, polypropylene, polyethylene, polyamide, polyurethane, and PVC. The same polymers are suitable for the sheath component, but the melting point of the sheath component must be at least 10° C. lower than the melting point of the core component. A particularly advantageous choice of polymers for the sheath/core filaments of the nonwoven-fabric sheeting of the invention is the use of polyester as the core component and polyamide, in particular nylon-6, as the sheath component. The percentage by volume of the sheath in the sheath/core filaments is preferably between 5% and 40%, in particular between 10% and 35%.

An objective of the present invention is met in a particularly satisfactory manner in the nonwoven-fabric sheeting of the invention when the separation of adjacent reinforcement yarns is between 2 and 30 mm, in particular between 4 and 15 mm.

The nonwoven-fabric sheeting of the invention is further distinguished by a number of particularly advantageous properties that emphasize the suitability of this nonwoven-fabric sheeting as an interlining for bituminous sheeting or as sheeting for roofing underlayers, but also as tufting backing for carpets.

The modulus of the nonwoven-fabric sheeting of the present invention at 5% elongation is preferably at least 170N, and in particular at least 190N, per 5 cm and per 100 g nonwoven-fiber weight.

The elongation at break of the nonwoven-fabric sheeting of the present invention can be adjusted well by combining suitable filaments with a binder that ensures the elongation at break. The elongation at break, however, can also be adjusted by suitable selection of filaments A and/or filaments B. The elongation at break is preferably between 15% and 70%. The elongation at break for bituminous sheeting can easily be adjusted from 15% to 50%, and for tufting backing from 30% to 65%.

The breaking strength is preferably between 300 and 600N, in particular between 400 and 550N per 5 cm and per 100 g, while the tear propagation resistance is between 100 and 300N, preferably between 130 and 250N, per 100 g.

The modulus, elongation at break, and breaking strength are determined on a 5 cm wide strip in which the reinforcement yarns run longitudinally, at a drawing rate of 20 cm/min and a temperature of 21° C. (DIN 53 857). If multiple sheets of crossing reinforcement yarns are present, the modulus can be measured in each direction of the reinforcement yarns.

The tear propagation resistance is measured on a 5 cm wide strip in which the reinforcement yarns run transversely, at a drawing rate of 10 cm/min and a temperature of 21° C. (DIN 53 363). In this case as well, the tear propagation resistance of crossing reinforcement yarns can be measured transversely to each respective direction of the reinforcement yarns.

The nonwoven-fabric sheeting of the invention also exhibits outstanding mechanical stability at high temperature. The mechanical stability at high temperature in the longitudinal and transverse directions is determined as follows. A 10 cm long by 8 cm wide rectangle is drawn in the center of the surface of a strip of 60 cm length and 10 cm width, where the longer side is oriented in the longitudinal direction. The strip is secured between two clamps such that the length between the clamps is about 25 cm. After a 10-minute treatment in an oven heated to 180° C. at a load of 57N, the dimensions of the drawn-on rectangle are measured. The ratio of the difference from the original length and width of the drawn-on rectangle to its original length and width is then expressed as a percentage.

The nonwoven-fabric sheeting of the invention preferably has a stability $S_1$ in the longitudinal direction such that $4.2-(0.015\times W)\geqq S_1>0$ where W is the total weight of the nonwoven-fabric sheeting in g/m$^2$. A stability $S_t$ in the transverse direction such that $-4.8+(0.017\times W)\leqq S_t\leqq 0$ where W is the total weight of the nonwoven-fabric sheeting in g/m$^2$, is a further preferred embodiment of the nonwoven-fabric sheeting of the invention.

The invention will be further illustrated with reference to the following specific examples. It is understood that these examples are given byway of illustration and are not meant to limit the disclosure or the claims to follow.

Bicomponent filaments of the sheath/core type, in which the core is polyethylene terephthalate and the sheath is nylon-6, are produced in a manner well known in the art to yield a core comprising 73% by volume and a sheath comprising 27% by volume. The sheath/core filaments are then drawn and as a result have a breaking strength of 36 cN/tex, an elongation at break of 64%, and a titer of 1,650 dtex. The sheath/core filaments are laid in a known manner onto a moving steel-fabric belt, where the feed rate of the sheath/core filaments is 358 m/min (Example 1) and 376 m/min (Example 2), and the speed of the moving steel-fabric belt is 20 m/min (Example 1) and 13 m/min (Example 2). 143 yarns per m are laid onto the sheath/core filaments, which were laid uniformly in random orientation, at a rate equal to the speed of the moving steel-fabric belt, whereby each yarn consists of 110 sheath/core filaments of the same type used to produce the first random-orientation layer. Over the structure thus formed, an additional layer of sheath/core filaments of the same type is added in the same manner as the first layer, such that the latter are arranged, again in random orientation, on top of the first random-orientation layer and the subsequently laid parallel yarns. Hot air at a temperature of 224° C. is then blown through the resultant structure and the steel-fabric belt. This thermal treatment, which is followed by a cooling cycle, effects the bonding of the resultant filament-reinforced nonwoven-fabric sheeting, which then exhibits the following properties:

| Example | | 1 | 2 |
|---|---|---|---|
| Weight per unit area | g/m2 | 110 | 170 |
| Nodulus at 5% elongation | N/5 cm | 223 | 320 |
| Elongation at break | % | 35 | 40 |
| Breaking strength | N/5 cm | 580 | 893 |
| Tear propagation resistance | N | 238 | 365 |
| Stability in longitudinal direction $S_1$ | % | 2.0 | 1.0 |
| Stability in transverse direction $S_t$ | % | −2.0 | −1.0 |

While the invention has been described with preferred embodiments, it is to be understood that variations and modifications are to be considered within the preview and the scope of the claims appended hereto.

What is claimed is:

1. Filament-reinforced nonwoven-fabric sheeting reinforced by sheets of parallel reinforcement yarns integrated into said nonwoven-fabric sheeting, wherein a binder binds filaments A of the nonwoven fabric to filaments B of said reinforcement yarns at crossing points of filaments A and B, and binds filaments B to each other at least at some crossing points BB, and binds filaments A of said nonwoven-fabric to each other at crossing points AA, and wherein said nonwoven-fabric sheeting has a breaking strength of 300 to 600N per 5 cm and per 100 g in each direction of said reinforcement yarn, and a tear propagation resistance of 100 to 300N per 100 g.

2. Nonwoven-fabric sheeting in accordance with claim 1, wherein said reinforcement yarns are oriented at least substantially in the longitudinal direction of said nonwoven-fabric sheeting.

3. Nonwoven-fabric sheeting in accordance with claim 1, wherein at least two sheets of parallel reinforcement yarns are integrated into said nonwoven-fabric sheeting such that said reinforcement yarns cross.

4. Nonwoven-fabric sheeting in accordance with claim 1, wherein one sheet of said parallel reinforcement yarns is oriented at least substantially in the longitudinal direction and another sheet of said parallel reinforcement yarns at least substantially in the transverse direction of said nonwoven-fabric sheeting.

5. Nonwoven-fabric sheeting in accordance with claim 1, wherein said binder is a fusible binder whose melting point is lower than the melting points of filaments A and B of said nonwoven-fabric sheeting.

6. Nonwoven-fabric sheeting in accordance with claim 1, wherein filaments A of said nonwoven fabric and filaments B of said reinforcement yarns are made of similar polymers.

7. Nonwoven-fabric sheeting in accordance with claim 1, wherein filaments A of said nonwoven fabric and filaments B of said reinforcement yarns are made of the same polymer.

8. Nonwoven-fabric sheeting in accordance with claim 1, wherein at least one of filaments A of said nonwoven fabric and filaments B of said reinforcement yarns are bicomponent filaments.

9. Nonwoven-fabric sheeting in accordance with claim 5, wherein filaments A of said nonwoven fabric and filaments B of said reinforcement yarns are bicomponent filaments in which one component of said bicomponent filaments is said fusible binder.

10. Nonwoven-fabric sheeting in accordance with claim 9, wherein said bicomponent filaments are sheath/core filaments in which the sheath is said fusible binder.

11. Nonwoven-fabric sheeting in accordance with claim 10, wherein said core component is a polyester and said sheath component is a polyamide.

12. Nonwoven-fabric sheeting in accordance with claim 10, wherein said sheath component is nylon-6.

13. Nonwoven-fabric sheeting in accordance with claim 10, wherein said sheath of said sheath/core filaments comprises between 5% and 40% by volume.

14. Nonwoven-fabric sheeting in accordance with claim 13, wherein said sheath of said sheath/core filaments comprises between 10% and 35% by volume.

15. Nonwoven-fabric sheeting in accordance with claim 1, wherein the separation of adjacent reinforcement yarns is between 2 and 30 mm.

16. Nonwoven-fabric sheeting in accordance with claim 1, wherein the separation of adjacent reinforcement yarns is between 4 and 15 mm.

17. Nonwoven-fabric sheeting in accordance with claim 1, wherein said nonwoven-fabric sheeting has a modulus at 5% elongation of at least 170N per 5 cm and per 100 g nonwoven-fiber weight, measured in each respective direction of said reinforcement yarns.

18. Nonwoven-fabric sheeting in accordance with claim 17, wherein said nonwoven-fabric sheeting has a modulus at 5% elongation of at least 190N per 5 cm and per 100 g, measured in each respective direction of said reinforcement yarns.

19. Nonwoven-fabric sheeting in accordance with claim 1, wherein said nonwoven-fabric sheeting has an elongation at break of 15% to 70% in each respective direction of said reinforcement yarns.

20. Nonwoven-fabric sheeting in accordance with claim 19, wherein said nonwoven-fabric sheeting has an elongation at break of 15% to 50% in each respective direction of said reinforcement yarns.

21. Nonwoven-fabric sheeting in accordance with claim 19, wherein said nonwoven-fabric sheeting has an elongation at break of 20% to 65% in each respective direction of said reinforcement yarns.

22. Nonwoven-fabric sheeting in accordance with claim 1, wherein said nonwoven-fabric sheeting has a breaking strength of 400 to 550N per 5 cm and per 100 g in a direction of said reinforcement yarns.

23. Nonwoven-fabric sheeting in accordance with claim 1, wherein said nonwoven-fabric sheeting has a tear propagation resistance of 130 to 250N per 100 g.

24. Nonwoven-fabric sheeting in accordance with claim 1, wherein said nonwoven-fabric sheeting has a stability $S_1$ in the longitudinal direction such that $4.2-(0.015\times W) \geqq S_1 > 0$, where W is the total weight of said nonwoven-fabric sheeting in $g/m^2$.

25. Nonwoven-fabric sheeting in accordance with claim 1, wherein said nonwoven-fabric sheeting has a stability $S_t$ in the transverse direction such that $-4.8+(0.017\times W) \leqq S_t \leqq 0$, where W is the total weight of said nonwoven-fabric sheeting in $g/m^2$.

* * * * *